US006126711A

United States Patent [19]

Kusui et al.

[11] Patent Number: 6,126,711

[45] Date of Patent: Oct. 3, 2000

[54] RAW MATERIAL FOR POWDER METALLURGY AND MANUFACTURING METHOD THEREOF

[75] Inventors: Jun Kusui; Kazuhiko Yokoe; Kazuo Fujii, all of Osaka; Kyo Takahashi, Wako; Kosuke Doi, Wako; Hiroyuki Horimura, Wako; Hisao Hattori, Itami; Toshihiko Kaji, Itami; Yoshinobu Takeda, Itami; Koji Yamada, Itami, all of Japan

[73] Assignees: Toyo Aluminium Kabushiki Kaisha, Osaka; Honda Giken Kogyo Kabushiki Kaisha, Tokyo; Sumitomo Electric Industries, Ltd., Osaka, all of Japan

[21] Appl. No.: 09/313,007

[22] Filed: May 17, 1999

[30] Foreign Application Priority Data

May 29, 1998 [JP] Japan ..... 10-166403

[51] Int. Cl.[7] ..... B22F 1/00

[52] U.S. Cl. ..... 75/252; 148/513

[58] Field of Search ..... 75/252, 235, 249; 419/19, 32, 31; 148/513

[56] References Cited

U.S. PATENT DOCUMENTS

| | | | |
|---|---|---|---|
| 3,816,080 | 6/1974 | Bomford et al. . | |
| 4,297,136 | 10/1981 | Pickens et al. . | |
| 5,372,775 | 12/1994 | Hayashi et al. | 419/10 |
| 5,763,109 | 6/1998 | Tabuchi et al. | 428/640 |

FOREIGN PATENT DOCUMENTS

| | | |
|---|---|---|
| 0701003 | 3/1996 | European Pat. Off. . |
| 939537 | 2/1956 | Germany . |
| 1179005 | 10/1964 | Germany . |
| 4302721 | 8/1994 | Germany . |
| 04028471 | 1/1992 | Japan . |
| 07305130 | 11/1995 | Japan . |
| 08134575 | 5/1996 | Japan . |
| 1300752 | 12/1972 | United Kingdom . |

OTHER PUBLICATIONS

"Hardness and Wear Property of SiCp Reinforced Aluminium Matrix Composite", by Fukaura et al.; Feb. 1997 in "Powder and Powder Metallurgy"; pp. 198–201.

*Primary Examiner*—Ngoclan Mai
*Attorney, Agent, or Firm*—W. F. Fasse; W. G. Fasse

[57] ABSTRACT

A raw material for powder metallurgy contains at least 0.5 vol % and at most 10 vol % of alumina powder of which the sieve fraction with a sieve opening of 30 $\mu$m is at most 0.1 wt %, and a remaining part of aluminum alloy powder. The moisture content of the alumina powder is at most 0.15 wt. % with respect to the alumina powder. Agglomeration of particles is thereby minimized or avoided. Highly reliable raw material for powder metallurgy having superior fatigue strength, impact resistance and wear resistance can be obtained. A method of preparing such a mixed powder raw material involves air classifying the powder materials, dry ball mixing the materials, and then annealing the mixed powder.

26 Claims, 2 Drawing Sheets

10 μm

10 μm

RAW MATERIAL FOR POWDER METALLURGY AND MANUFACTURING METHOD THEREOF

BACKGROUND OF THE INVENTION

1. Field of the Invention

The present invention relates to a raw material for powder metallurgy and a manufacturing method thereof. More specifically, the present invention relates to a highly reliable raw material for an alumina particle dispersed aluminum matrix composite and a manufacturing method thereof.

2. Description of the Background Art

Though various and many alumina particle dispersed aluminum matrix composite materials and raw materials therefor have been developed, almost none has been successively used in practice, because of inadequate reliability. Durability, flaw ratio and cost are major problems to be solved. What is important in solving these problems is how to mix alumina powder and aluminum alloy powder finely and uniformly. Most of the conventional approaches simply reduce the particle size (or mean particle diameter) of the powder.

The smaller the particle size of the powder, the higher the cost, and when the particle size is simply reduced, there arises a new problem of agglomeration. The agglomerated powder is the main cause of degraded reliability. Once generated, agglomerated powder cannot be readily separated, and the agglomerated powder is kept agglomerated until in the final product. The size of the agglomeration may attain as large as 100 μm to several mm, and therefore generation of the agglomerated powder causes the same defect as a foreign matter mixed in the final product. It decreases strength, fatigue strength, impact strength, toughness and heat resistance, and significantly degrades reliability of the material.

Conventionally, most of the materials are prepared by simply mixing alumina powder just commercially available, with aluminum alloy powder by means of a V-blender. Even when some particle size adjustment is performed, the adjustment may be simple screening out of bulky particles by sieve classification.

SUMMARY OF THE INVENTION

An object of the present invention is to provide a highly reliable raw material for powder metallurgy providing a finished product having superior fatigue strength, impact strength and wear resistance, and to provide a manufacturing method thereof.

The inventors made many attempts in view of the problems described above, and attained the invention as described in the following.

The inventive raw material for powder metallurgy contains 0.5 vol % to 10 vol % of alumina powder of which the sieve fraction on the sieve opening of 30 μm is 0.01 wt % or less, and a remaining part of aluminum alloy powder.

Alumina powder used in the present invention must have such particle size that attains sieve fraction of 0.01 wt % or less when a sieve of the opening of 30 μm is used. If the sieve fraction exceeds 0.01 wt %, reliability of the material degrades significantly, and therefore the material would not be appropriate for engine parts for vehicles or machine parts.

The blended amount of alumina powder must be at least 0.5 vol % and at most 10 vol %. If the blended amount is smaller than 0.5 vol %, the effect of the matrix material, especially wear resistance, is inferior, and when it exceeds 10 vol %, impact strength and fatigue strength are degraded. Preferable blended amount of alumina powder is 2 to 8 vol %.

The aluminum alloy powder used in the present invention is not specifically limited, and generally, powder of which particle size is −150 μm (by sieve), and preferably −75 μm may be used. As to the manufacturing method, gas atomizing method, melt spinning method and rotating disk method may be available, and gas atomizing method is preferable for industrial production.

When the particle size exceeds 150 μm, uniform mixing may become difficult, and bulky particles may degrade reliability. In terms of average particle diameter (in accordance with laser diffraction method), the size is preferably 10 to 100 μm and more preferably, 20 to 40 μm. The powder may have the shape of tear drops, spherical, spheroid, flaky or irregular shape. The atomizing medium/atmosphere for the gas atomizing method may be air, nitrogen, argon, vacuum, carbon dioxide or a mixture thereof.

The alloy composition includes Al—-Ni base, Al—Fe base, Al—Si base, Al—Mg base, Al—Cu base and Al—Zn base. Elements to be added may include transition metal element such as Ti, V, Cr, Mn, Mo, Nb, Zr and W. For the application to engine parts of a vehicle, Al—Fe—Si base, Al—Ni—Si base and Al—Fe—Cr—Zr base may be used.

In the above described raw material for powder metallurgy, preferably, the alumina powder has the particle size adjusted such that the mean particle diameter is at least 1.5 μm and at most 10 μm, and content of powder having the particle size outside of the range of 1.5 μm to 10 μm is at most 10 wt %.

The mean particle diameter D50 (in accordance with laser diffraction method) must be at least 1.5 μm and at most 10 μm. If it is smaller than 1.5 μm, particles are much prone to agglomeration, and if it exceeds 10 μm, the effect of reinforcement attained by alumina powder is decreased, and in addition, mechanical machining becomes difficult. Preferable mean particle diameter is at least 2 μm and at most 5 μm. More preferably, it should be at least 2 μm and at most 4 μm.

Further, particles outside of the range of 1.5 μm to 10 μm must be at most 10 wt %. When particles smaller than 1.5 μm or exceeding 10 μm are extremely large in amount, the above described problems are more likely.

In the raw material for powder metallurgy described above, preferably, the moisture content of alumina powder is at most 0.15 wt % with respect to the alumina powder.

The alumina powder may include unavoidable impurity if substantial alumina ingredient is maintained. The moisture content, however, is preferably at most 0.15 wt %. If the moisture content exceeds 0.15 wt %, fine particles of alumina are prone to agglomeration, degrading reliability. The moisture content may be reduced by heating, if necessary.

In the above described raw material for powder metallurgy, the moisture content of the entire mixed powder containing alumina powder and aluminum alloy powder is at most 0.1 wt %.

The powder after mixing and annealing should preferably have the moisture content of at most 0.1 wt %. If the moisture content exceeds 0.1 wt %, agglomeration is likely between alumina particles with each other, aluminum alloy powder particles with each other or alumina and aluminum alloy powder particles with each other.

Using the raw material for powder metallurgy described above to form a compact by not forming, the defect rate of defects of at least 200 μm in the compact after hot forming is at most 6/kg by nondestructive testing using ultrasonic defect detection.

If the number of defects of at least than 200 μm is at most 6/kg when tested by nondestructive testing using ultrasonic defect detection, the mechanical properties are not degraded even when the material is processed to parts of various shapes, and sufficient reliability is ensured. If the number of agglomeration defects is larger, a mechanical property, especially fatigue strength, is significantly degraded.

Preferably, such form is obtained through the steps of mixing powders, forming the mixed powder to a pre-form of about 60 to 80% (relative density) by cold pressing or CIP (Cold Isostatic Pressing) using a rubber container, for example, heating the pre-form so that substantial temperature attains 400 to 550° C., and forming to substantially 100% density (relative density of at least 99%) through hot extrusion or powder forging. In the cold pressing or CIP, when aluminum alloy powder as the main component of the mixed powder has high hardness, form density sufficient to handling cannot be obtained, and the form is more likely to be broken during handling. If the mixed powder is annealed for at least one hour at a temperature of 250 to 400° C., hardness of the powder decreases, and a pre-form of sufficient density can be obtained by cold forming. The preferable time period for annealing is about 3 to about 15 hours.

At the temperature lower than 250° C., the effect of annealing, i.e. decrease in hardness of the powder, is not sufficient, and therefore improvement is not sufficient. If the temperature exceeds 400° C., though hardness of the powder decreases, the micro structure in the aluminum alloy powder, i.e. precipitates and the matrix, becomes coarser, which lowers strength or the like when the powder is formed to a compact. As to the annealing time, the thermal conductivity of the powder is low, and therefore generally at least one hour is necessary, though it depends on the amount of the powder.

The method of manufacturing the raw material for powder metallurgy in accordance with the present invention is characterized in that aluminum alloy powder and alumina powder of which the particle size has been adjusted by air classification are subjected to dry mixing using ball medium.

In the method of manufacturing the raw material for powder metallurgy in accordance with the present invention, bulky particles and agglomerated particles of alumina powder are removed and at the same time, super fine powder such as bug dust are removed by air classification. Therefore, powder of which particle size distribution is sharp can be obtained.

The alumina powder and the aluminum alloy powder may be mixed by using a commercially available mixer. It should be noted that generation of agglomerated particles must be prevented by using balls as dispersion medium. Simple mixing of the alumina powder and aluminum alloy powder by a blender cannot readily provide uniform mixing, and therefore reliability is degraded. Use of balls prevents generation of agglomerated particles by the effect of impact and crushing between balls and between the ball and an inner wall of the mixer, as well as by the effect of stirring.

Because of the air classification and use of balls as dispersion medium, it becomes possible to obtain a mixed powder containing fine alumina powder, of which sieve fraction on the sieve opening of 30 $\mu$m is at most 0.01 wt %, by at least 0.5 vol %, and a at most 10 vol % and remaining part of aluminum alloy powder.

The particle size of the alumina powder may be adjusted by using a commercially available air classifier or a cyclone. For example, turbo classifier manufactured by Nisshin Engineering may be used. Air, nitrogen, carbon dioxide or the like may be used as classification medium, and use of dry air is preferable. Before and after air classification, drying may be performed to prevent generation of agglomerated particles.

Balls made of ceramics such as alumina, zirconia, aluminum nitride, silicon nitride or the like, balls made of plastics such as nylon, and balls made of hard rubber may be used. Each ball preferably has a diameter of about 5 to about 30 mm, and the amount of balls is preferably about 1/20 to 2/1 volume ratio of the entire mixed powder. The time for mixing is about 10 minutes to about 6 hours generally, though it depends on the type of the mixer. Drying may be performed before and after mixing as needed, to prevent generation of agglomerated particles.

According to the present invention, the alumina particle dispersed aluminum alloy raw material containing extremely few agglomerated particles can be obtained, and the compact formed thereof exhibits superior specific strength, heat resistance, fatigue strength, high modulus and wear resistance as well as superior relative toughness and ductility and impact strength. Therefore, material of high quality incomparable with the prior art can be obtained, which material can be applied to engine parts for a vehicle, mechanical parts, sporting goods, components for OA equipments and other sintered parts.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

EXAMPLE 1

In aluminum alloy powder produced by air atomization, 5 wt % of alumina samples listed in Table 1 were each mixed by using a mixing medium of nylon balls, the mixed powders were subjected to CIP and hot extrusion to be formed to have substantially 100% density (relative density of not lower than 99%) and the thus formed compacts (or forms) were subjected to a ultrasonic defect detection. Thereafter, the compacts were each subjected to a Charpy impact test, tensile test at 150° C. and rotary bending fatigue test at 150° C. The results are as shown in Table 2.

Here, the alloy powder used had the alloy composition of Al-11.6Fe-1.7Ti-1.9Si (wt %), which was passed through a sieve having openings of 75 $\mu$m. The specimens for the Charpy impact test were flat ones without any notch, and fatigue strength was measured as the fatigue strength at $10^7$ cycles in accordance with S-N curve (stress-endurance curve). The same is applied throughout the following examples.

TABLE 1

| | Mean Particle Diameter | Amount of +30 μm Coarse Particles | Classification |
|---|---|---|---|
| Alumina A | 2.8 μm | 30 ppm | Air Classification by turbo classifier |
| Alumina B | 2.8 μm | 60 ppm | Air Classification by turbo classifier |
| Alumina C | 2.9 μm | 150 ppm | Air Classification by turbo classifier |
| Alumina D | 3.1 μm | 250 ppm | No Classification |

TABLE 2

| | Mixed Raw Material | Number of Ultrasonic Detected Defect (Not Smaller than 200 μm) | Charpy Impact Value | Tensile Strength (150° C.) | Fatigue Strength (150° C.) | Evaluation |
|---|---|---|---|---|---|---|
| Form A | Alumina A and Aluminum Alloy Powder | 0/kg | 19.1 J/cm$^2$ | 430 MPa | 260 MPa | ○ |
| Form B | Alumina B and Aluminum Alloy Powder | 4/kg | 18.5 J/cm$^2$ | 421 MPa | 255 MPa | ○ |
| Form C | Alumina C and Aluminum Alloy Powder | 10/kg | 16.2 J/cm$^2$ | 420 MPa | 237 MPa | x |
| Form D | Alumina D and Aluminum Alloy Powder | 18/kg | 15.6 J/cm$^2$ | 420 MPa | 220 MPa | x |

It can be seen from the results above that comparts or forms A and B containing alumina powder of which the amount of +30 μm coarse particles was at most 0.01 wt % (30 ppm and 60 ppm) had at most 6/kg defects of not smaller than 200 μm, a Charpy impact value of at least 18 J/cm$^2$, and a fatigue strength at 150° C. of at least 240 MPa. Therefore, it was found that highly reliable forms could be obtained.

In Table 1, the amount of +30 μm coarse particles was measured in accordance with the method of testing sieve fraction in compliance with JIS K5906-1991.

Figure 1:
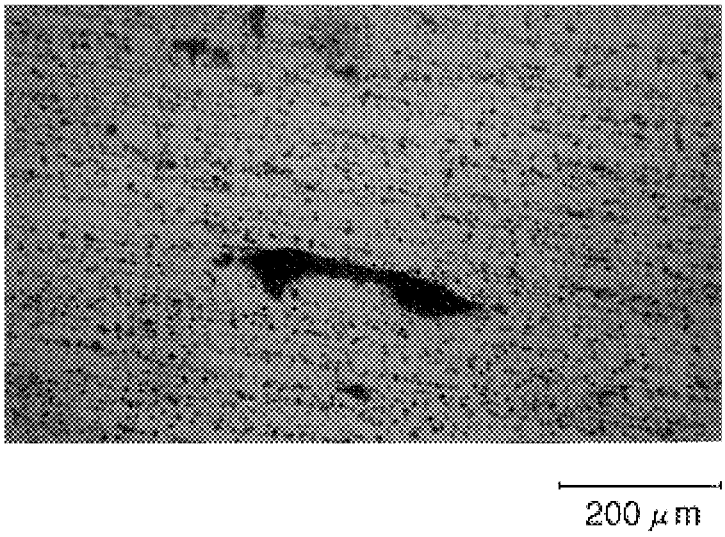
FIG. 1 is an optical microscope photograph showing a defect having a size of at least 200 $\mu$m.
Figure 2:
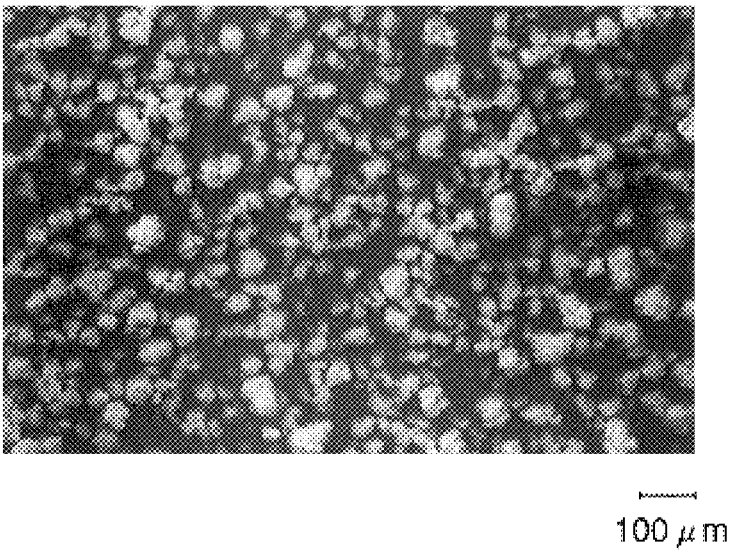
FIG. 2 is a photograph (SEM) showing alumina particles of +30 $\mu$m agglomeration.
Figure 3:
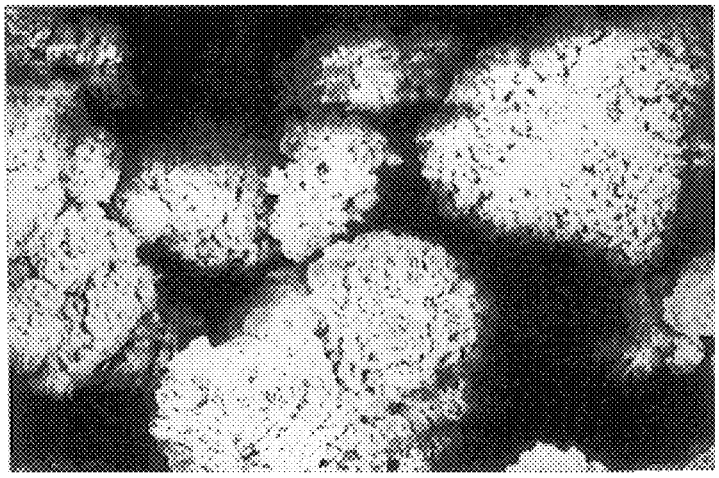
FIG. 3 is a photograph (SEM) showing in enlargement the agglomeration of FIG. 2.
Figure 4:
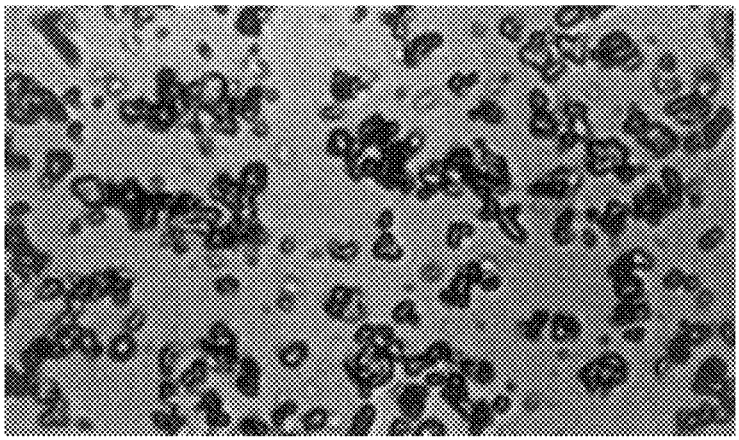
FIG. 4 is a photograph showing particles of alumina in which an amount of coarse particles of +30 $\mu$m is 0.01 wt % or less.

FIG. 1 is an optical microscopic photograph showing a defect of not smaller than 200 μm (i.e. having a size of at least 200 μm), FIG. 2 is a photograph (SEM) showing a particle structure of +30 μm agglomeration, FIG. 3 is an enlarged photograph (SEM) of FIG. 2, and FIG. 4 is a photograph showing a particle of alumina particles of which the amount of +30 μm coarse particles is at most 0.01 wt %.

EXAMPLE 2

Mixed powders were prepared by adding various amounts of alumina samples A used in Example 1 to the aluminum matrix alloy powder used in Example 1, thus prepared mixed powders were subjected to CIP and hot extrusion, to be formed to compacts having a relative density of at least 99%. The resulting compacts were subjected to a Charpy impact test, a tensile test at 150° C. and a rotary bending fatigue test at 150° C., and the amount of wear was measured. The results are as shown in Table 3.

Here, the specimens for the Charpy impact test were flat ones without any notch, and the fatigue strength was the fatigue strength (fatigue limit) at $10^7$ cycles in accordance with S-N curve (stress-endurance curve).

TABLE 3

| Blended Amount of Alumina (vol %) | Charpy Impact Test Value | Tensile Strength (150° C.) | Fatigue Strength (150° C.) | Wear Amount | Evaluation |
|---|---|---|---|---|---|
| 0.2 | 22.0 J/cm$^2$ | 393 MPa | 254 MPa | 4.5 μm | x |
| 0.5 | 21.5 J/cm$^2$ | 396 MPa | 251 MPa | 0.5 μm | ○ |
| 3.0 | 19.6 J/cm$^2$ | 410 MPa | 253 MPa | 0.2 μm | ○ |
| 7.0 | 18.2 J/cm$^2$ | 428 MPa | 248 MPa | 0.1 μm | ○ |
| 12.0 | 15.3 J/cm$^2$ | 434 MPa | 215 MPa | 0.1 μm | x |

From the results, it can be seen that when the amount of blended alumina was at least 0.5 vol % and at most 10 vol %, the Charpy impact value was at least 18 J/cm$^2$, the fatigue strength at 150° C. was at least 240 MPa and the amount of wear was small, and thus compacts or forms with superior properties could be obtained.

EXAMPLE 3

In the aluminum matrix alloy powder used in Example 1, alumina samples of different moisture contents shown in Table 4 at 5 vol % were mixed, the mixed powders were subjected to CIP and hot extrusion to be formed to compacts having relative density of at least 99%, and the compacts or forms were subjected to ultrasonic defect detection, a Charpy impact test, a tensile test at 150° C. and a rotary bending fatigue test at 150° C. The results are as shown in Table 4.

TABLE 4

| Moisture Content of Alumina Powder | Moisture Content of Mixed Powder | Number of Ultrasonic Detected Defect (Not Smaller than 200 μm) | Charpy Impact Test Value | Tensile Strength (150° C.) | Fatigue Strength (150° C.) | Evaluation |
|---|---|---|---|---|---|---|
| 0.08 wt % | 0.07 wt % | 1/kg | 18.8 J/cm$^2$ | 426 MPa | 261 MPa | ○ |
| 0.13 wt % | 0.09 wt % | 5/kg | 18.7 J/cm$^2$ | 425 MPa | 253 MPa | ○ |
| 0.20 wt % | 0.14 wt % | 9/kg | 17.3 J/cm$^2$ | 419 MPa | 235 MPa | x |
| 0.25 wt % | 0.17 wt % | 16/kg | 16.1 J/cm$^2$ | 420 MPa | 225 MPa | x |

From the results, it was found that if the moisture content of the alumina powder was at most 0.15 wt %, the number of defects of not smaller than 200 μm was at most 6/kg, th e Charpy impact value was at least 18 J/cm$^2$ and the fatigue strength at 150° C. was at least 240 MPa.

EXAMPLE 4

The aluminum matrix alloy powder used in Example 1 and 5 vol % of alumina samples with varying amounts of particles outside the range of 1.5 to 10 μm varied as shown in Table 5 were mixed, the mixed powders were subjected to CIP and hot extrusion to be formed to compacts having relative density of at least 99%, and the compacts or forms were subjected to a Charpy impact test, a tensile test at 150° C. and a rotary bending fatigue test of 150° C. The results are as shown in Table 5.

TABLE 5

| Amount of Particles Outside 1.5–10 μm Range in Alumina | Charpy Impact Test Value | Tensile Strength (150° C.) | Fatigue Strength (150° C.) | Evaluation |
|---|---|---|---|---|
| 0.5 wt % | 19.6 J/cm$^2$ | 433 MPa | 258 MPa | ○ |
| 3.0 wt % | 19.5 J/cm$^2$ | 430 MPa | 262 MPa | ○ |
| 7.0 wt % | 18.8 J/cm$^2$ | 424 MPa | 248 MPa | ○ |
| 12.0 wt % | 15.9 J/cm$^2$ | 397 MPa | 214 MPa | x |

From the results of Table 5, it was found that if the amount of particles outside the range of 1.5 to 10 μm in alumina was at most 10 wt %, then the Charpy impact value was at least 18 J/cm$^2$ and the fatigue strength at 150° C. was at least 240 MPa.

EXAMPLE 5

The aluminum matrix alloy powder used in Example 1 was mixed with 5 vol % of alumina by a method ① using mixing ball medium (alumina balls) and by a method ② not using the ball medium, and the thus produced mixed powders were subjected to CIP and hot extrusion to be formed to compacts having the relative density of at least 99%, and the compacts were subjected to a Charpy impact test, a tensile test at 150° C. and a rotary bending fatigue test at 150° C. The results are as shown in Table 6.

Here, conditions for the mixing methods ① and ② were as follows.

Mixing method ①: alumina balls of 20ϕ were used and dry mixed, and 5 kg of alumina balls were used for 20 kg of mixed powder.

Mixing method ②: dry mixed without using mixing ball medium.

TABLE 6

| | Number of Ultrasonic Detected Defect | Charpy Impact Test Value | Tensile Strength (150° C.) | Fatigue Strength (150° C.) | Evaluation |
|---|---|---|---|---|---|
| Mixing Method ① | 1/kg | 18.8 J/cm$^2$ | 433 MPa | 258 MPa | ○ |
| Mixing Method ② | 24/kg | 14.3 J/cm$^2$ | 397 MPa | 208 MPa | x |

From the results, it was found that when the mixing method ① using mixing ball medium was employed, the number of defects of not smaller than 200 μm could be reduced to at most 6/kg, a Charpy impact value of at least 18 J/cm$^2$ could be attained and a fatigue strength at 150° C. of at least 240 MPa could be attained.

Mixed powder samples of 20 kg each were put in stainless containers, one sample was subjected to annealing at 350° C. for ten hours in air and the other sample was not subjected to annealing, and the thus prepared samples were filled in rubber containers having inner diameter of ϕ30×85 mm and ϕ200×300 mm. Thereafter, the samples were subjected to CIP forming, and specimens for flexural strength testing and CIP forms of the pre-forms for powder extrusion were fabricated. The pieces for flexural strength testing were subjected to a flexural strength test. The results are as shown in Table 7.

TABLE 7

| | Pre-form for Powder Extrusion | CIP Form Flexural Strength |
|---|---|---|
| Annealed | No Crack | 4.6 kgf/cm$^2$ |
| Not Annealed | Split into Two | 2.8 kgf/cm$^2$ |

From the results, it was found that the pre-forms subjected to annealing were free of cracks and had high transverse strength, while pre-forms without annealing were broken into two during the test and had low transverse strength of 2.8 kgf/cm$^2$.

As described above, according to the present invention, alumina particles dispersed in aluminum alloy raw material of uniform quality with extremely few agglomerated particles can be obtained, and forms or compacts thereof exhibit superior specific strength, heat resistance, fatigue strength, high modulus and wear resistance as well as superior relative toughness and ductility and impact strength. Thus a highly reliable material not comparable to the prior art can be provided, which can be applied to engine parts for a vehicle, mechanical parts, sporting goods, components for OA equipments and other sintered parts.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A raw material for powder metallurgy, containing at least 0.5 vol. % and at most 10 vol. % of an alumina powder and a remainder of an aluminum alloy powder, wherein said alumina powder has a sieve fraction of at most 0.01 wt. % being retained on a sieve with a sieve opening of 30 μm, and wherein said alumina powder has a moisture content of at most 0.15 wt. % with respect to a total weight of said alumina powder.

2. The raw material according to claim 1, wherein said alumina powder contains dry alumina and a positive amount of moisture such that said moisture content is at most 0.15 wt. % with respect to said total weight of said alumina powder.

3. The raw material according to claim 1, wherein said moisture content of said alumina powder is at most 0.13 wt. % with respect to said total weight of said alumina powder.

4. The raw material according to claim 1, wherein said raw material is a mixed powder essentially consisting of said alumina powder and said aluminum alloy powder mixed together, and wherein said mixed powder has an overall moisture content of at most 0.1 wt. % with respect to a total weight of said mixed powder.

5. The raw material according to claim 4, wherein said moisture content of said mixed powder is at most 0.09 wt. % with respect to said total weight of said mixed powder.

6. The raw material according to claim 1, wherein said alumina powder consists of alumina powder particles having a mean particle diameter of at least 1.5 μm and at most 10 μm, and including at most 10 wt. % of alumina powder particles having a particle diameter outside of a range from 1.5 μm to 10 μm.

7. The raw material according to claim 6, wherein said alumina powder particles include at most 7 wt. % of said alumina powder particles having a particle diameter outside of said range from 1.5 μm to 10 μm.

8. The raw material according to claim 6, wherein said mean particle diameter of said alumina powder particles is at least 2 μm and at most 5 μm.

9. The raw material according to claim 8, wherein said mean particle diameter of said alumina powder particles is at most 4 μm.

10. The raw material according to claim 1, wherein said aluminum alloy powder consists of aluminum alloy particles having an average particle diameter of at least 20 μm and at most 40 μm.

11. The raw material according to claim 1, having a particle size distribution as results from air classification of said alumina powder, and dry ball mixing of said alumina powder and said aluminum alloy powder.

12. The raw material according to claim 1, containing at least 2 vol. % and at most 8 vol. % of said alumina powder.

13. The raw material according to claim 1, containing at most 7 vol. % of said alumina powder, and wherein said alumina powder has a sieve fraction of at most 60 ppm being retained on a sieve with a sieve opening of 30 μm.

14. The raw material according to claim 1, having such particle size and agglomeration characteristics so that a compact formed by hot forming said raw material will have at most 6 defects of a size of at least 200 μm per kilogram of said compact when evaluated by nondestructive ultrasonic defect detection testing.

15. The raw material for powder metallurgy, consisting of a mixed powder containing at least 0.5 vol. % and at most 10 vol. % of an alumina powder and a remainder of an aluminum alloy powder, wherein said alumina powder has a sieve fraction of at most 0.01 wt. % being retained on a sieve with a sieve opening of 30 μm, and wherein said mixed powder has an overall moisture content of at most 0.1 wt. % with respect to a total weight of said mixed powder.

16. The raw material according to claim 15, wherein said alumina powder consists of alumina powder particles having a mean particle diameter of at least 1.5 μm and at most 10 μm, and including at most 10 wt. % of alumina powder particles having a particle diameter outside of a range from 1.5 μm to 10 μm.

17. The raw material according to claim 16, wherein said mean particle diameter of said alumina powder particles is at least 2 μm and at most 5 μm.

18. The raw material according to claim 17, wherein said mean particle diameter of said alumina powder particles is at most 4 μm.

19. The raw material according to claim 15, containing at least 2 vol. % and at most 8 vol. % of said alumina powder.

20. The raw material according to claim 15, having such particle size and agglomeration characteristics so that a compact formed by hot forming said raw material will have at most 6 defects of a size of at least 200 μm per kilogram of said compact when evaluated by nondestructive ultrasonic defect detection testing.

21. A method of manufacturing a raw material for powder metallurgy, comprising the following steps:

a) providing an aluminum alloy powder;

b) air classifying an alumina powder so as to have a selected alumina powder particle size distribution;

c) preparing said alumina powder to have a moisture content of at most 0.15 wt. % with respect to a total weight of said alumina powder; and d) dry mixing said aluminum alloy powder and said alumina powder using a ball medium to prepare a mixed powder as said raw material.

22. The method according to claim 21, wherein said dry mixing is carried out for a duration of at least ten minutes and at most six hours.

23. The method according to claim 21, further comprising a step of annealing said mixed powder at a temperature of at least 250° C. and at most 400° C.

24. The method according to claim 23, wherein said annealing is carried out for a duration of at least one hour.

25. The method according to claim 23, wherein said annealing is carried out for a duration of at least three hours and at most fifteen hours.

26. The method according to claim 21, wherein said step of providing said aluminum alloy powder comprises powderizing a molten aluminum alloy by any one of gas atomization, melt spinning, and a rotating disk process.

* * * * *

UNITED STATES PATENT AND TRADEMARK OFFICE

CERTIFICATE OF CORRECTION

PATENT NO. : 6,126,711

DATED : October 3, 2000

INVENTOR(S) : Kusui et al.

It is certified that error appears in the above-identified patent and that said Letters Patent is hereby corrected as shown below:

| | |
|---|---|
| Col. 1, | line 58, after "vol %", insert --,--; before "remaining", insert --a--; |
| Col. 7, | line 17, after "6/kg,", delete "th"; |
| | line 18, before "Charpy", replace "e" by --the--; |
| Col. 10, | line 7, before "raw", replace "The" by --A--. |

Signed and Sealed this

First Day of May, 2001

*Attest:*

Nicholas P. Godici

NICHOLAS P. GODICI

*Attesting Officer*

*Acting Director of the United States Patent and Trademark Office*